US005356473A

United States Patent [19]

Fromm

[11] Patent Number: 5,356,473

[45] Date of Patent: Oct. 18, 1994

[54] DIRT BLADE FOR RAM SYSTEMS

[75] Inventor: Paul M. Fromm, Rochester, N.Y.

[73] Assignee: Xerox Corporation, Stamford, Conn.

[21] Appl. No.: 990,567

[22] Filed: Dec. 14, 1992

[51] Int. Cl.[5] ..... B05C 11/00; B05C 21/00; G03G 21/00

[52] U.S. Cl. ..... 118/60; 118/104; 118/117; 118/203; 219/216; 355/283

[58] Field of Search ..... 118/60, 203, 104, 117; 355/283; 219/216

[56] References Cited

U.S. PATENT DOCUMENTS

| | | | |
|---|---|---|---|
| 4,214,549 | 7/1980 | Moser | 118/60 |
| 4,407,219 | 10/1983 | Dellevoet | 118/60 |
| 5,142,122 | 8/1992 | Ariyama | 118/60 X |

*Primary Examiner*—Michael W. Ball
*Assistant Examiner*—M. Curtis Mayes

[57] ABSTRACT

A customer replaceable (CRU) metering cartridge for use in a release agent management (RAM) system. The CRU represents a self-contained supply of silicone oil including a sump charged with a predetermined quantity of silicone oil. The cartridge is a sealed unit which prevents escape of silicone oil therefrom.

2 Claims, 3 Drawing Sheets

DIRT BLADE FOR RAM SYSTEMS

BACKGROUND OF THE INVENTION

The present invention relates to fuser apparatus for electrostatographic printing machines and in particular to release agent management (RAM) systems for a heat and pressure roll fuser.

In imaging systems commonly used today, a charge retentive surface is typically charged to a uniform potential and thereafter exposed to a light source to thereby selectively discharge the charge retentive surface to form a latent electrostatic image thereon. The image may comprise the discharged portions and/or the charged portions of the charge retentive surface, the former in the case of tri-level imaging and the latter in the case of conventional xerography. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about $1\times10^{-9}$ meters to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

Various systems have been used to deliver release agent fluid to the fuser roll including the use of oil soaked rolls and wicks with and without supply sumps and/or reservoirs as well as oil impregnated Another type of RAM system is disclosed in U.S. Pat. No. 4,214,549 granted to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll.

A large part of the cost of servicing mid-volume copiers is related to adding silicone oil to the sump. The problem is particularly aggravated when relatively high (i.e. 13,000 cs) viscosity oil is utilized. The high viscosity oils require relatively long periods of time for sump replenishment. Moreover, conventional methods of oil replacement such as pouring from a bottle are quite messy as well as time consuming in the case of the high viscosity oils.

The problems that release agent materials cause in xerographic imaging products is well known. One of the biggest problems with oil is the havoc it creates if it leaks into the wrong place. Moreover, the service of parts contaminated with oil presents problem.

BRIEF SUMMARY OF THE INVENTION

The present invention provides a customer replaceable (CRU) silicone oil metering cartridge for use with a release agent management (RAM) system. The CRU represents a self-contained supply of silicone oil including a sump charged with a predetermined quantity of silicone oil.

A unitary structure including a metering blade, a dirt collecting blade and a pair of ends seals contain the silicone oil in the sump. A metering roll is supported by the sump for rotational movement and is contacted by the blades and end seals for containing the silicone oil in the sump. If any of these elements fail the cartridge is replaced.

The metering roll conveys silicone oil from the sump to a windowed area through which the metering roll or brush is contacted by a donor roll or brush to which a predetermined amount of silicone oil is transferred from the metering roll.

Lastly, oil transferred to the donor roll or brush is transferred to a fuser member which may be the member that contacts the powder images to be adhered to a substrate or the member that contacts the backside of the substrate.

DETAILED DESCRIPTION OF THE PREFERRED EMBODIMENT(S) OF THE INVENTION

Figure 1:
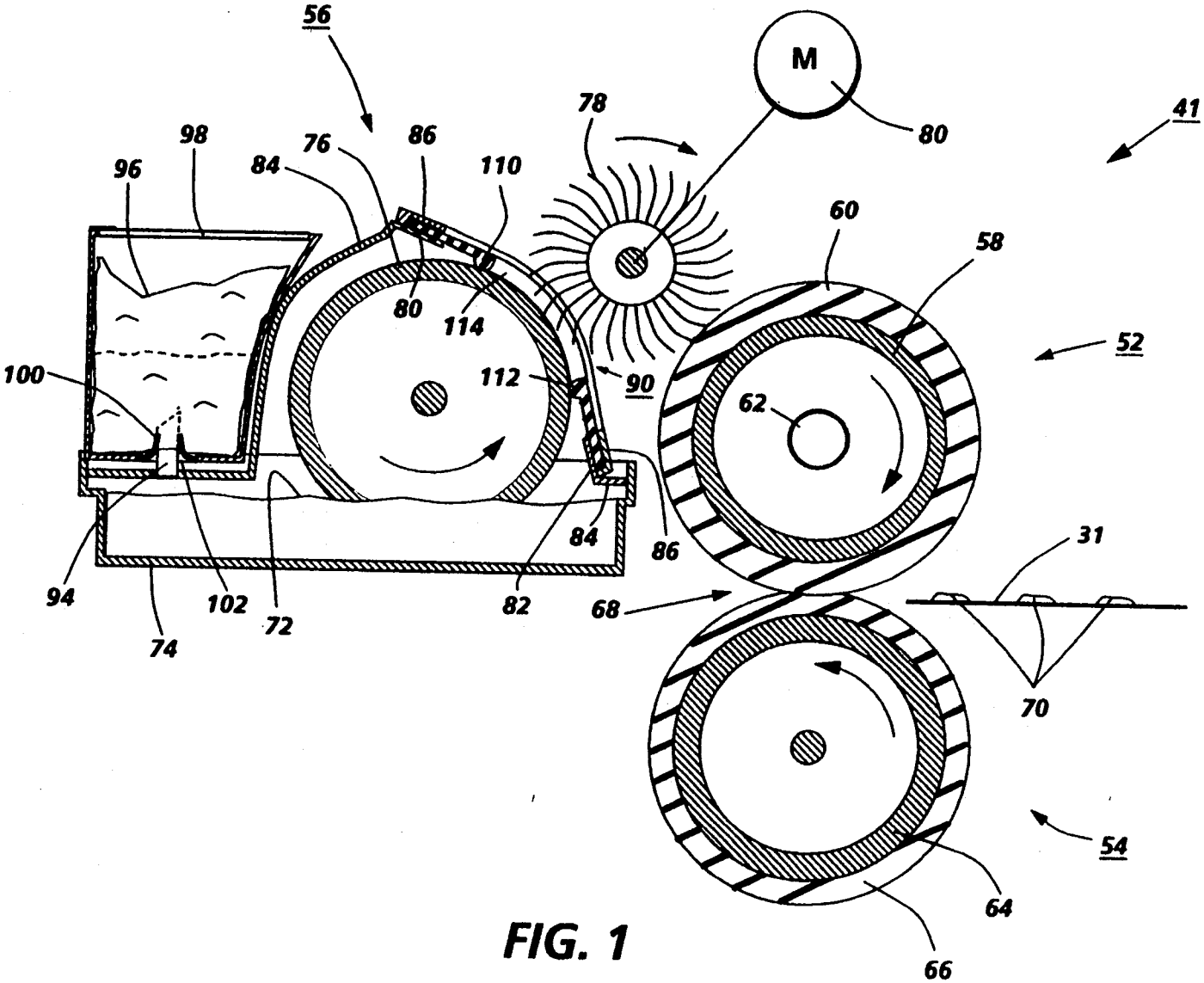
FIG. 1 is a schematic illustration of a side view of a customer replaceable silicone oil metering cartridge.
Figure 3:
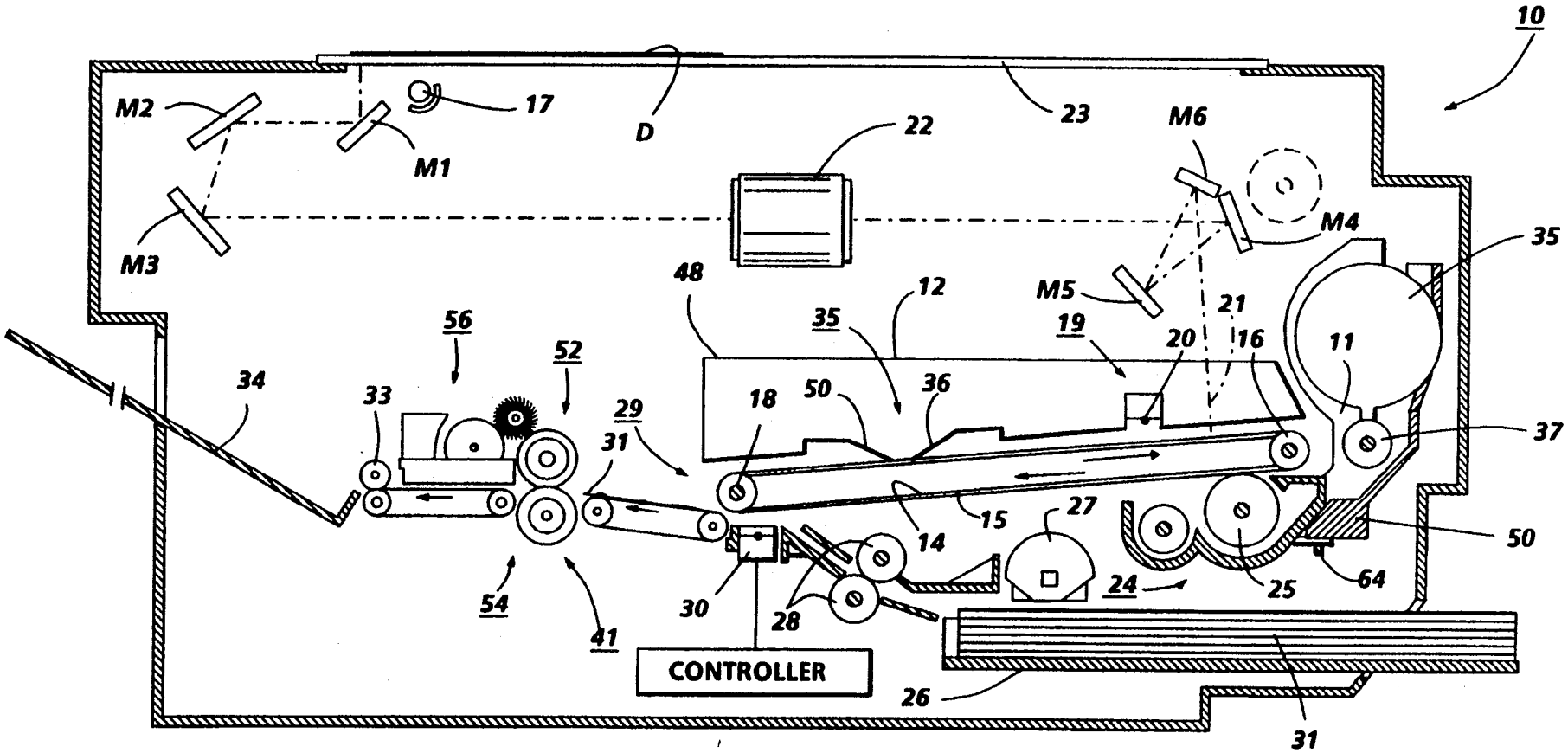
FIG. 3 a schematic of the xerographic process stations including the active members for image formation as well as the control members operatively associated therewith of a xerographic printing apparatus.

Referring now to FIG. 3, there is shown by way of example, an automatic electrostatographic reproducing machine 10 which includes a removable processing cartridge 12. The reproducing machine depicted in FIG. 1 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 1 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors $M_1$, $M_2$, $M_3$ mounted to a scanning carriage (not shown) to scan an original document D on an imaging platen 23. Lens 22 and mirrors $M_4$, $M_5$, $M_6$ transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fixing station 41 comprising heated fuser roll 52 and pressure roll 54 forming a nip therebetween wherein roll fuser 52 fixes the transferred powder image thereto.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scrapping contact with the outer periphery of the belt 14. The particles so removed are contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Attention is now directed to FIG. 1 wherein the heat and pressure fuser apparatus comprising the fuser roll 52 and pressure roll 54 are illustrated together with a release agent management (RAM) system 56. As shown in FIG. 1, the fuser apparatus comprises the heated fuser roll 52 which is composed of a core 58 having coated thereon a thin layer 60 of an elastomer. The core 58 may be made of various metals such as iron, aluminum, nickel, stainless steel, etc., and various synthetic resins. Aluminum is preferred as the material for the core 58, although this is not critical. The core 58 is hollow and a heating element 62 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials such as the RTV and HTV silicone elastomers or Teflon, a trademark of E. I. du Pont de Nemours & Co.

The fuser roll 52 is shown in a pressure contact arrangement with the backup or pressure roll 54. The pressure roll 54 comprises a metal core 64 with a layer 66 of a heat-resistant material. In this assembly, both the fuser roll 52 and the pressure roll 54 are mounted on bearings (not shown) which are biased so that the fuser roll 52 and pressure roll 54 are pressed against each other under sufficient pressure to form a nip 68. It is in this nip that the fusing or fixing action takes place. The layer 66 may be made of any of the well known materials such as fluorinated ethylene propylene copolymer or silicone rubber.

The image receiving member or final support 31 having toner images 70 thereon is moved through the nip 68 with the toner images contacting the heated fuser roll 52. The toner material forming the image 70 is prevented from offsetting to the surface of the fuser roll 52 by the application of a release agent material such as silicone oil 72 contained in sump 74 forming part of the RAM system of cartridge 56.

The oil metering cartridge 56 constitutes a customer replaceable (CRU) silicone oil metering cartridge for use with a release agent management (RAM) system. The CRU represents a self-contained supply of silicone oil including the sump 74 charged with a predetermined quantity of silicone oil 72.

The metering roll conveys silicone oil from the sump to a windowed area through which the metering roll is contacted by a donor roll or brush to which a predetermined amount of silicone oil is transferred from the metering roll.

Lastly, oil transferred to the donor roll or brush is transferred to a fuser member which may be the member that contacts the powder images to be adhered to a substrate or the member that contacts the backside of the substrate.

The sump 74 and silicone oil 72 form part of the RAM system 56 further comprising a metering roll 76 and a donor brush 78. The metering roll is supported partially immersed in the silicone oil 72 and contacts the donor brush for conveying silicone oil from the sump to the bristles of the donor brush 78. The donor brush is rotatably supported in contact with the metering roll and also in contact with the fuser roll 52. While the donor brush is illustrated as contacting the fuser roll, it will be appreciated that, alternately, it may contact the pressure roll 54. Also, the positions of the fuser and pressure rolls may be reversed for use in other copiers or printers.

Whereas the contact of the donor roll of the '549 patent with its associated metering roll and the roll to which it delivers silicone oil is intimate (i.e. a high percentage of contact) the area of contact of the donor brush 78 with the fuser roll 52 and the metering roll 76 is only about 10%. The low percentage of contact between the donor brush and the provides for low torque transmission form the donor brush to the metering and fuser rolls. In operation, the donor brush tends to slide relative to the metering and pressure rolls and the area of contact therebetween is very low, approximately 10%.

The donor brush may be operatively connected to the pressure roll to be driven thereby or it may be driven independently via a drive motor 80. The metering roll is operatively connected to a motor (not shown) for driving it independently of the fuser roll and donor brush. The metering roll is a smooth-surfaced metal or plastic roll on which the oil picked up from the sump is metered to the desired thickness by a metering blade 84.

The donor brush 78 is fabricated using heat-resistant fibers made of, by way of example, the copolymer of meta-phenylenediamine and isophthaloyl chloride. A loading pressure of 5 to 10 PSI causes the donor brush to conform to the surfaces of the fuser and metering rolls. Operational speed of the brush is such that the brush fibers deliver in the order of 1 to 6 $\mu$l of silicone oil.

Figure 2:
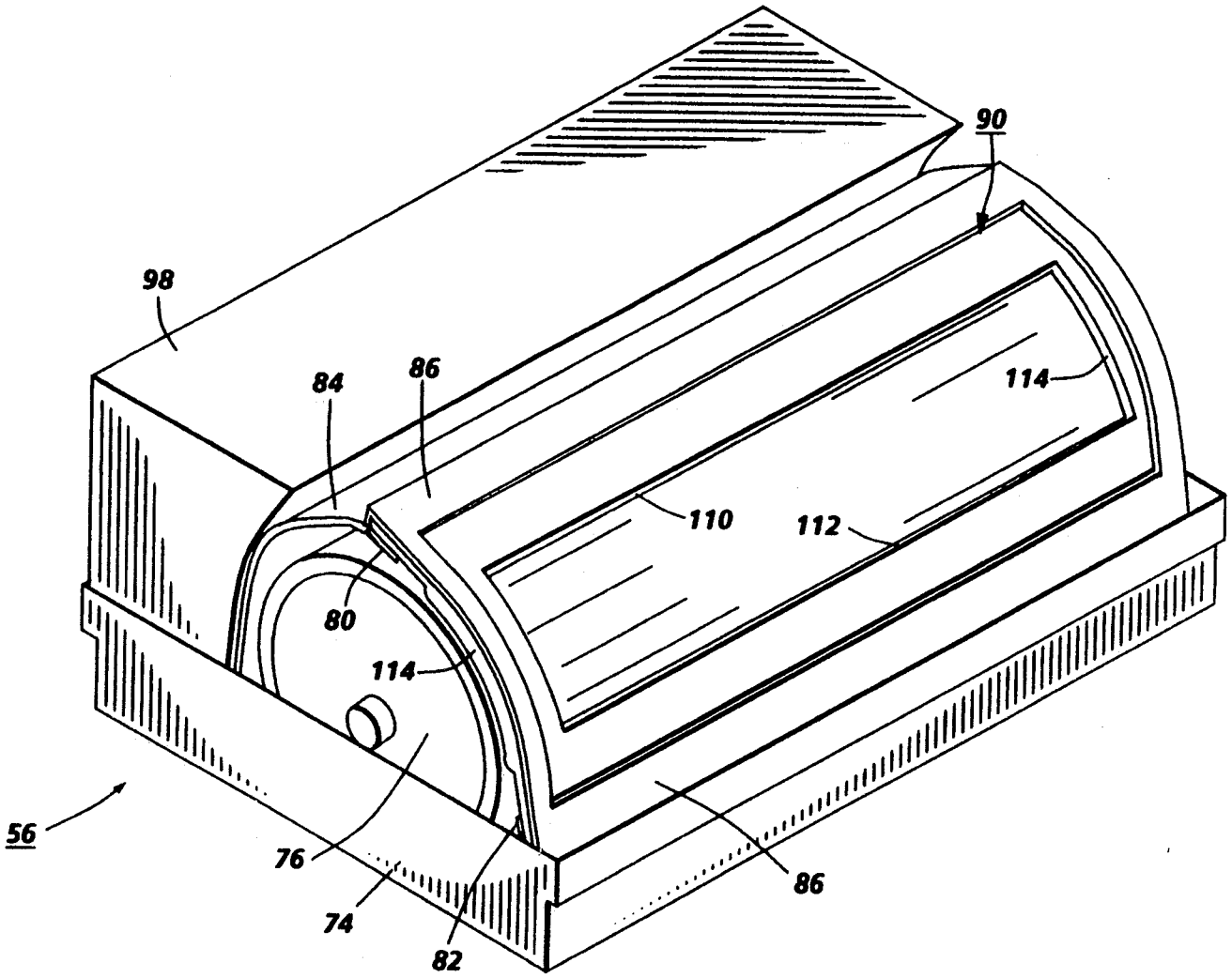
FIG. 2 is schematic illustration of an oil metering system for the fuser of the printing apparatus of FIG. 3.

The sump 74 has formed integrally therewith a wall structure 84 which encompasses a portion of the metering roll 76 (FIGS. 1 and 2). A combination blade and seal clamping structure 86 cooperates with the extremities 80 and 82 of the wall structure 84 to captivate a unitary blade and seal structure 90. The clamping structure may be screwed onto or ultrasonically staked to the extremities of the wall structure 84 in order to hold or retain the combination blade and seal structure 90 in place.

A hollow tube 94 attached to the wall member 92 serves to drain silicone oil from a soft bag 96 contained in a rigid frame or box member 98 into the sump 74.

All of the oil in the bag is preferably drained into the sump 74 via the tube. To this end the capacity of the sump area is approximately twice that of the bag. It is intended that the box/bag structure be removed once the contents of the bag have emptied into the sump. With the bag and box removed, it is possible for other bags to be installed. To prevent oil from exiting the bag when it is removed before it is empty, a resealable elastomer member 100 forms part of the bag 96. The member 100 is similar to that used for bottles of injectable medicine.

To furnish silicone oil to the sump, the box member 98 is placed over the spout 94 and allowed to come to rest on top of the wall member 92. As the box member is placed on the top of the wall, the hollow tube 94 passes through an opening 102 therein and pierces the seal member 100. Silicone oil then flows from the bag into the sump 74.

The combination blade and seal structure 90 comprises a dirt removal blade 110 which functions to keep dirt out of the oil sump and keep oil in the sump. The structure 90 further comprises a metering blade 112. The metering blade 112 is normally is used to meter oil on the rotating metering roll to a predetermined film thickness. Part of that film is then removed by the donor roll or brush and paper fibers and other dirt is transferred from the donor member to the metering roll The metering roll rotates to bring this debris into the oil sump where it either collects in an oil swiper wick or in a layer on the floor of the sump. Some of the debris usually finds its way up to the metering blade and causes a streak of low oil because it increases the local pressure at the blade/dirt/metering roll interface. It also can cause a streak of high oil by wedging into the space near the blade/roll contact zone and lifting the blade off the roll or reducing the pressure. The dirt removal blade 110 functions to keep dirt out of the oil and ultimately improve oil uniformity produced by the metering blade.

As illustrated in FIGS. 1 and 2, the unitary blade and seal structure further comprises a pair of end seals 114. The end seals, metering blade and dirt removal blade contact the surface of the metering roll 76 to prevent oil escape from the sump 74. The combination blade and seal structure 90 is preferably fabricated from an elastomeric material such as Viton TM.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. Fuser apparatus, said apparatus comprising:
first and second fuser members supported for contact with each, other;
means for heating at least one of said fuser members;
a release agent cartridge for use with a release agent management system including:
a sump containing release agent material;
a release agent metering member supported in said sump;
a donor member contacting said metering roll;
a metering blade contacting the surface of said metering roll for metering a predetermined quantity of release agent material, said metering blade being disposed upstream of said donor member;
a blade member disposed downstream of said donor member for collecting contaminants and precluding them from entering said sump; and
a pair of end seal members cooperating with said blade members to provide a sealed cartridge having an opening, provided by said end seals, blade member and said metering blade, though which said donor member contacts said metering member.

2. A release agent cartridge for use with a release agent management system, said apparatus comprising:
a sump containing release agent material;
a release agent metering member supported in said sump;
a donor member contacting said metering member;
a metering blade contacting the surface of said metering member for metering a predetermined quantity of release agent material, said metering blade being disposed upstream of said donor member;
a blade member contacting said metering member and being disposed downstream of said donor member for collecting contaminants and precluding them from entering said sump; and
a pair of end seal members cooperating with said blade members to provide a sealed cartridge having an opening, provided by said end seals, blade member and said metering blade, though which said donor member contacts said metering member.

* * * * *